US007614968B1

(12) United States Patent
Davies

(10) Patent No.: US 7,614,968 B1
(45) Date of Patent: Nov. 10, 2009

(54) BALL CATCHING SYSTEM FOR TRAINING SOCCER PLAYERS

(76) Inventor: John Davies, 2174 Hunt Crescent, Burlington, Ontario (CA) L7M 2P9

( * ) Notice: Subject to any disclaimer, the term of this patent is extended or adjusted under 35 U.S.C. 154(b) by 0 days.

(21) Appl. No.: 12/218,773

(22) Filed: Jul. 18, 2008

(51) Int. Cl.
*A63B 69/00* (2006.01)

(52) U.S. Cl. ..... 473/466; 273/400

(58) Field of Classification Search ..... 473/446, 473/512, 505; 273/400, 398; 116/173; D21/705; 52/157
See application file for complete search history.

(56) References Cited

U.S. PATENT DOCUMENTS 1,527,988 A * 3/1925 McMurtrie ..... 273/400
5,634,640 A * 6/1997 McCarrel ..... 473/446
5,725,444 A * 3/1998 Heden ..... 473/446
5,865,693 A * 2/1999 Johnson ..... 473/478
D420,074 S * 2/2000 Whitham-Taudien ..... D21/705
D449,084 S * 10/2001 Walters ..... D21/705
6,846,253 B1 * 1/2005 Szwalek ..... 473/446
6,860,825 B2 * 3/2005 Clark ..... 473/478

* cited by examiner

*Primary Examiner*—Gene Kim
*Assistant Examiner*—M Chambers

(57) ABSTRACT

One embodiment of the ball catching system for training soccer players having a frame with a rigid horizontal member and two vertical members, a soccer training net having a width that is a predetermined multiple of the horizontal member length and secured with elastic attachments to the frame and the ground. The soccer training net has a plurality of pockets throughout the rectangular surface. The pockets consist of two rectangular nets, a front net with a predetermined aperture larger than the diameter of a soccer ball and a rear net with a predetermined aperture smaller than the diameter of a soccer ball. The ball catching system can capture and hold at point of impact soccer balls hitting either the front or back of the soccer training net, whereby several drills to improve shooting skills and accuracy can be conducted simultaneously, saving valuable coaching time and increasing player participation.

12 Claims, 8 Drawing Sheets

BALL CATCHING SYSTEM FOR TRAINING SOCCER PLAYERS

CROSS REFERENCE TO RELATED APPLICATION

Not Applicable

FEDERALLY SPONSORED RESEARCH

Not Applicable

SEQUENCE LISTING OR PROGRAM

Not Applicable

BACKGROUND

1. Field of Invention

This invention relates to a ball catching system for training soccer players.

2. Prior Art

Soccer is a major global professional and recreational sport. According to a National Geographic study in 2006, soccer was played by more than 120 million regular players and countless others on beaches, playgrounds and streets.

Professional teams are more likely to have practice or training sessions 3 or 4 times per week. Amateur level teams usually have an organized training session at least once a week. In the local youth soccer leagues, training sessions usually take place at a local park, where the number of local youth teams having a practice session at the same time often limits training space. To make full use of the available field space and time (approximately a 60-90 minute session), a soccer coach must carefully plan the training drills.

At the youth level, one of the major functions of a soccer coach is to teach beginning players the basic individual skills required to become a good soccer player. An important skill for a soccer player to develop is shooting and scoring. Shots must be both accurate and powerful. Other skills include correctly connecting with the ball when shooting, heading, volleying, receiving and passing. These drills require lots of repetitive practice. At this early stage of a player's development, a coach will usually feed a ball to the player who would then kick, volley or head the ball forward. The distance the ball travels is not important here. The idea is for the young player to develop the art of making correct contact with the ball and understanding how the contact with the ball affected the trajectory of the ball.

In the game of soccer, a goal is awarded when the whole of the ball has crossed the goal line. When practicing penalty shots and direct free kicks, it is important to know exactly where the ball crosses the goal line. In practice sessions, this is more important than seeing where the ball hits the back of a regular goal net. However, it is difficult if not impossible for the coach or player to judge where the ball crossed the goal line and thus obtain feedback on the shooting or heading technique.

Soccer coaches use a variety of practice drills to further develop the skills of young players. A good example of this is the circuit drill, which involves a number of players and very often the whole squad of players. Several versions for setting up for this type of group drill are used.

One example is to have a group of players stand in a line approximately 25 yards out from the goal. The coach is positioned about 10 yards in front of and at an angle to the first player in the line. The coach will have lots of soccer balls at his feet. To start the drill the coach will pass a ball to the first player in the line who then dribbles around several cones before shooting at the goal net. The player then sprints to the back of the line of players to wait his/her turn to repeat the drill. Depending on the skill levels and the number of players involved the waiting time could be from 1 to 2 minutes. During this time, the players tend to become distracted and start to lose focus on the drill they are working on.

During soccer training sessions, it is not unusual for precious training time to be wasted. Wasted training time can be caused by a number of reasons, for example, retrieving stray balls that have been kicked beyond the boundaries of the practice area, players having to stand in line waiting for their turn to perform certain individual drills such as heading, shooting, dribbling, and shooting practice at a soccer goal with or without a net. When the player's shot misses the goal completely the soccer balls have to be retrieved for as much as 10 to 30 yards behind the goal.

In order to provide coaches and players greater feedback during their practice sessions and more effectively utilize the limited field and training time, several devices or practice nets have previously been proposed, but they suffer from several deficiencies. One such common net, which has a mesh size smaller than the diameter of a soccer ball, is suspended in a vertical plane and serves to stop the ball projected at it by the practicing soccer player. This soccer net thus serves, as with practice nets for other games, merely to provide an early termination of the ball trajectory so that practice is conveniently confined within a small space.

One disadvantage of such practice nets lies in the fact that the ball after striking the net and delivering up its kinetic energy immediately falls to the ground so that the exact place at which it struck the net is not recorded, but must be judged by eye. The absence of this information is a drawback so far as the soccer player is concerned since during training sessions it is important to know if the ball is consistently and accurately being directed to a particular location on the goal opening.

U.S. Pat. No. 5,725,444 discloses a training net that hangs vertically and that incorporates a limited number of relatively large pockets located in four or five locations that are judged important to develop a player's shooting skills. The limited number of pockets and the size of the opening for these pockets decrease the feedback the players receive during their practice sessions. Unless the ball enters the pocket, the player does not know how close the ball came to the target pocket. Since the pockets are at a limited number of fixed locations, the player is limited in terms of developing skills that will enable them to direct the ball at any location in the goal opening. Furthermore, this net an only be used from one side of the net, the side with the opening to the pocket, thereby limiting the type and number of practice drills and the number of players able to use the net at one time.

British patent GB2057895, discloses the construction of a ball game practice net that will capture a moving ball and retain it in the region in which the ball struck the net. In this disclosure, horizontal hanging pockets are created by appropriately joining two nets of different mesh sizes. The front large mesh net with an aperture larger than the diameter of the practice ball allows the ball to enter. The back net with an aperture smaller than the diameter of the practice ball retains the ball. The greater amount of the back net that is attached to the front net results in the creation of a pocket with a drooping form that serves to retain a captured ball, but also facilitates such capture when struck by the ball to absorb energy and avoid rebound. The construction of the pocket is illustrated in the three figures contained in GB2057895, reproduced below and designed as Prior Art FIG. 1, Prior Art FIG. 2 and Prior Art FIG. 3.

Prior Art FIG. 1 is a front elevation of one embodiment of a practice device constructed in accordance with the present invention.

Prior Art FIG. 2 is a side elevation of the device of Prior Art FIG. 1, and Prior Art FIG. 3 is a perspective view of a portion of the practice device of Prior Art FIG. 1 and Prior Art FIG. 2.

In order to verify the performance of the pocket design for a soccer training device, a net, with outside dimensions identical to the dimensions of the soccer frame, was constructed in accordance to the claims of the pocket design contained in patent GB2057895. This net was attached to the frame using traditional net fastening techniques such as ropes, hooks or non-extensible straps. Trials with this net demonstrated that up to 70% of the balls hitting the front of the net, the side with the large aperture mesh net, are retained by the pockets. However, it was also observed that about 30% of the time when the ball hits the net and is captured by a pocket, it initially bounces or slides away from the impact point and ends up falling into pockets that are immediately adjacent to the impact point or into pockets that could be two or three pockets away and around the impact point. Therefore, while the net captures up to 70% of the balls, only about 50% of the total balls hitting the net are captured and retained at the actual point of impact. When using the backside of the net for this performance evaluation session, it was observed that pockets, at the point of impact, capture about 40% of the balls hitting the back of this net. The back of the net is defined as the ball first hitting the small aperture net, pushing this net through the large aperture mesh net and falling into this inverted pocket.

It appears that the pocket design, claimed in British patent GB2057895, does not sufficiently absorb the kinetic energy of the ball and about 50% of the time the ball rebounds from the impact point and either falls to the ground or in some situations is subsequently caught in another pocket.

The pocket design disclosed in patent GB2057895 relies on the ball to drop into a pocket created out of the excess vertical material of the small aperture mesh net. However, in order for the ball to drop into this pocket, a certain amount of the net, a cone, parabolic like shape, has to wrap around the ball, travel in the direction of the ball, decelerate the ball and in the process remove the kinetic energy of the ball. Only after the ball has lost most of its kinetic energy, will the ball be able to drop or slide down the rear small aperture net and become trapped by this extra small aperture mesh. If the net does not wrap around the ball and absorb the kinetic energy of the ball, the net will act as an immovable object and the ball will rebound from the net without sliding down into the drooping pocket.

This low capture percentage for the front and back of the net with pockets made in accordance with GB2057895 would not provide the required training feedback to players making the net unsuitable for soccer training purposes and hence, commercially unattractive.

The present invention is directed to overcoming the problems encountered in the aforementioned patents

SUMMARY

In accordance with one embodiment, a soccer ball catching system comprises a soccer training net having a plurality of pockets for retaining a soccer ball and appropriate bungee or elastic cords and metal chains to attach the soccer training net to a rigid frame.

DRAWINGS

Figures

The following drawings form part of the specifications and are included to further demonstrate certain aspects of various embodiments. The embodiments may be better understood by reference to one or more of these drawings in combination with the detailed descriptions of specific embodiments and their operations.

DRAWINGS

Reference Numerals

Figure 1:
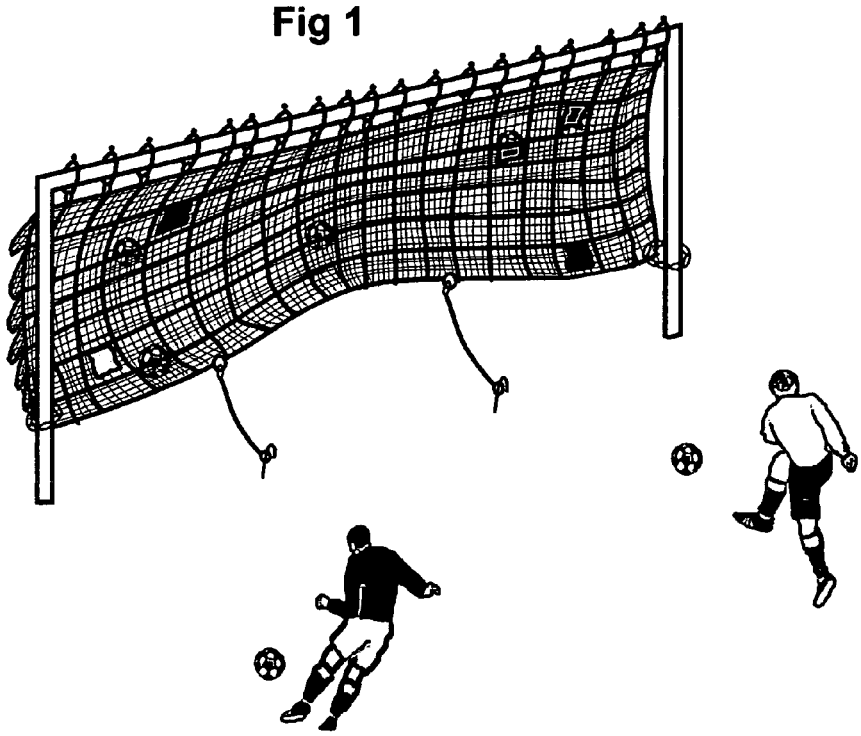
FIG. 1 shows a perspective view of the soccer ball catching system with the soccer training net deforming following the capture of a soccer ball. It is suggested that FIG. 1 be included on the front page of the patent application publication and patent.

The following three and four digit reference numerals form part of the specifications and are included to further demonstrate certain aspects of various embodiments. The first number of the three digit reference numerals represents the figure number. The first two numbers of the four digit reference numerals represents the figure number.

| | | | |
|---|---|---|---|
| 230 | soccer ball catching system | 966 | bungee ring |
| 332 | training net | 967 | bungee ring configuration |
| 234 | rectangular frame | 1172 | post chain |
| 235 | crossbar | 1274 | ground spike |
| 237 | vertical goalpost | 1276 | ground stretch bungee cord |
| 336 | top edge | 1278 | snap hook |
| 338 | bottom edge | 1280 | split ring |
| 340 | left side | 1282 | metal ring |
| 342 | right side | 1384 | target flag |
| 444 | front net | 1386 | hook |
| 546 | back net | 1388 | loop |
| 748 | pocket | 2189 | portable goal system |
| 750 | corner stitch | 490 | aperture of front net |
| 752 | corner stitch | 591 | aperture of back net |
| 754 | stitch | 2192 | portable rectangular frame |
| 756 | stitch | 493 | net line |
| 758 | stitch | 2294 | crossbar pipe |
| 760 | stitch | 2296 | crossbar pipe |
| 864 | bungee cord | 2298 | crossbar pipe |

DETAILED DESCRIPTION

First Embodiment

Figure 2:
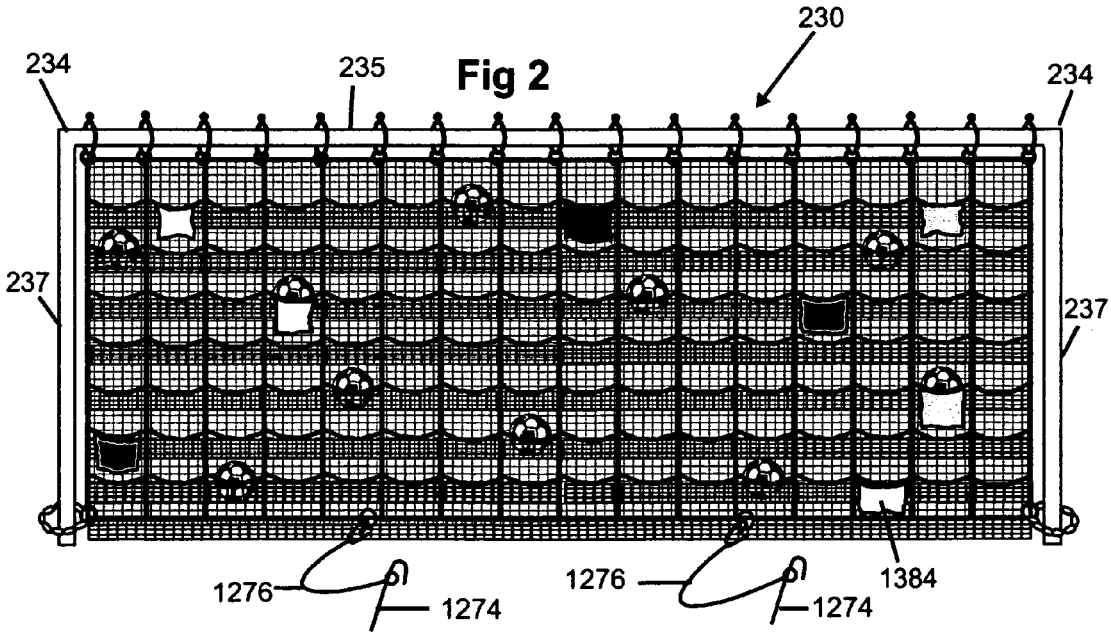
FIG. 2 shows a front view of the soccer ball catching system, which includes a soccer training net, attached with appropriate bungee rings, bungee cords and metal chains to a soccer frame and examples of several pockets each with one ball and several target flags attached at random to the net.

One embodiment of the ball catching system for soccer training is a soccer ball catching system 230 illustrated in FIG. 2. The soccer ball catching system 230 has a rectangular soccer training net 332, as shown in FIG. 3, with a plurality of pockets, attached to a rigid rectangular frame 234, a frame that is typical of fixed goals on soccer fields.

Figure 3:
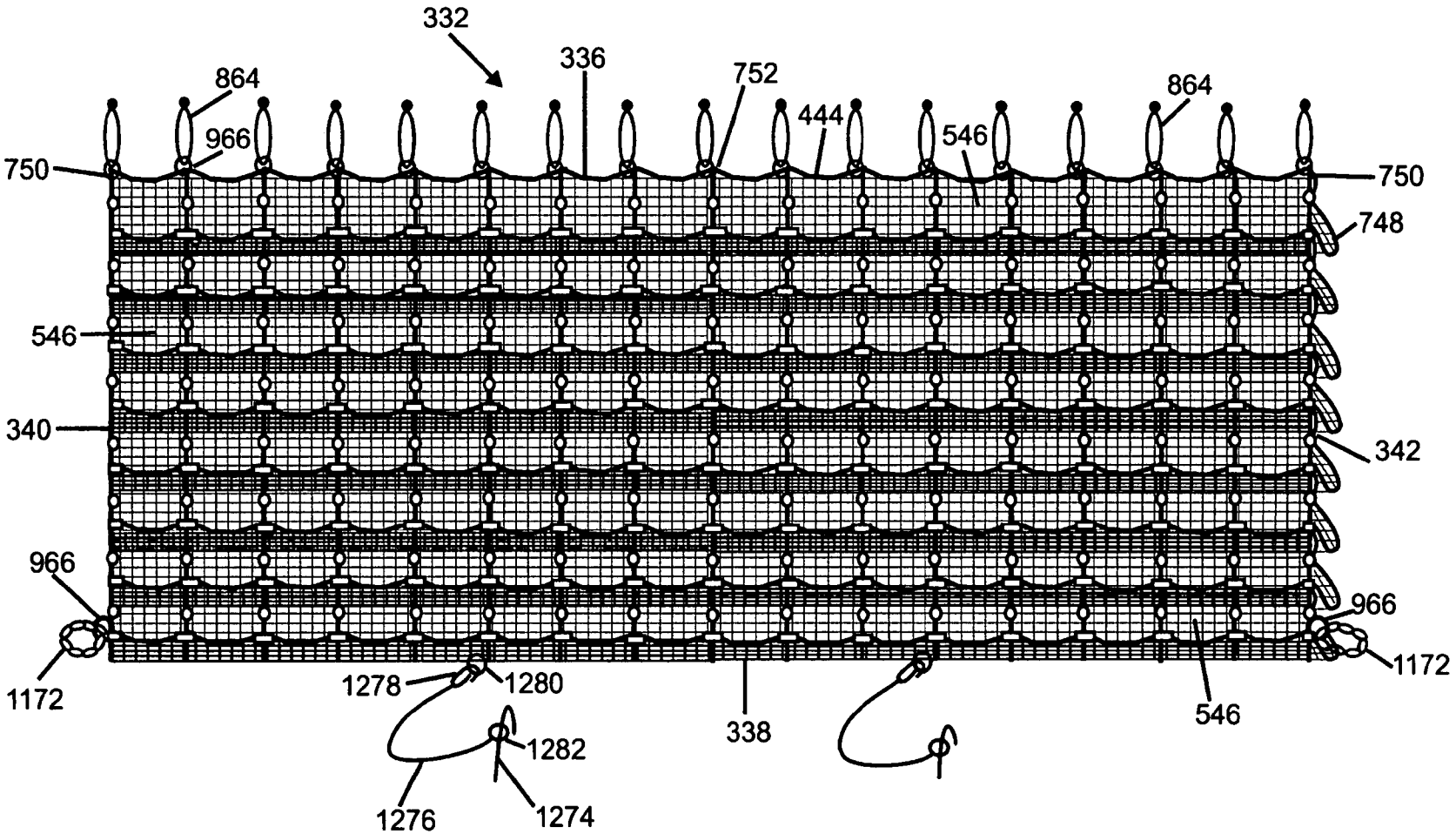
FIG. 3 shows a front view of the soccer training net with drooping pockets and the elastic cords and metal chain components required to attach the training net to a frame and the ground.

The soccer training net 332, as shown in FIG. 3, has a top edge 336, a bottom edge 338, a left side 340 and a right side 342. The top edge 336 and bottom edge 338 have a length that exceeds by 1.1 to 1.5 times the crossbar width 235 of the soccer frame 234. In this embodiment, the top edge 336 and bottom edge 338 have a length between 1.33 and 1.375 times the crossbar width 235 of the soccer frame 234. For a full size soccer frame with a crossbar width 235 of 7.31 m (24 ft), top edge 336 and bottom edge 338 of the soccer training net 332 have a length of 10.6 m (33 ft).

The left side 340 and the right side 342 of the soccer training net 332 have a length that is equal to or exceeds the height 237 of the soccer frame 234 by a factor of 1.2. In this embodiment, the left side 340 and right side 342 have a length equal to the height of the soccer goal. For a full size soccer frame, the height is 2.4 m (8 ft) and the length of the left side 340 and right side 342 of the soccer training net 332 is 2.4 m (8 ft).

The soccer training net 332 contains a pocket design disclosed in British patent GB2057895 and described in Prior Art FIG. 1, Prior Art FIG. 2 and Prior Art FIG. 3.

Figure 4:
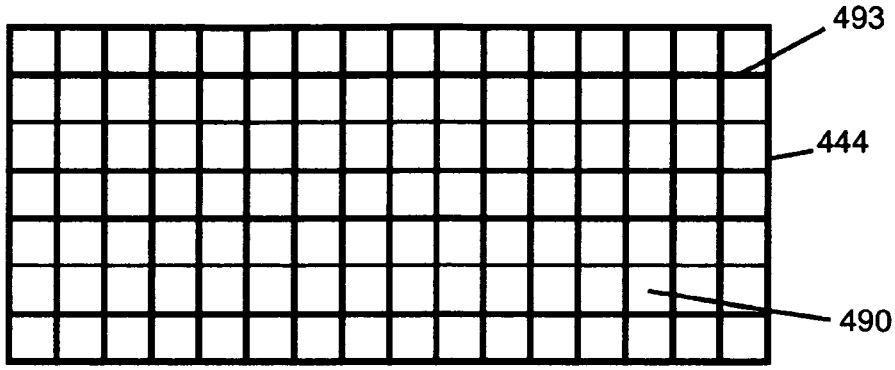
FIG. 4 shows a front view of the net with the large mesh that comprises the front net in the soccer training net.
Figure 5:
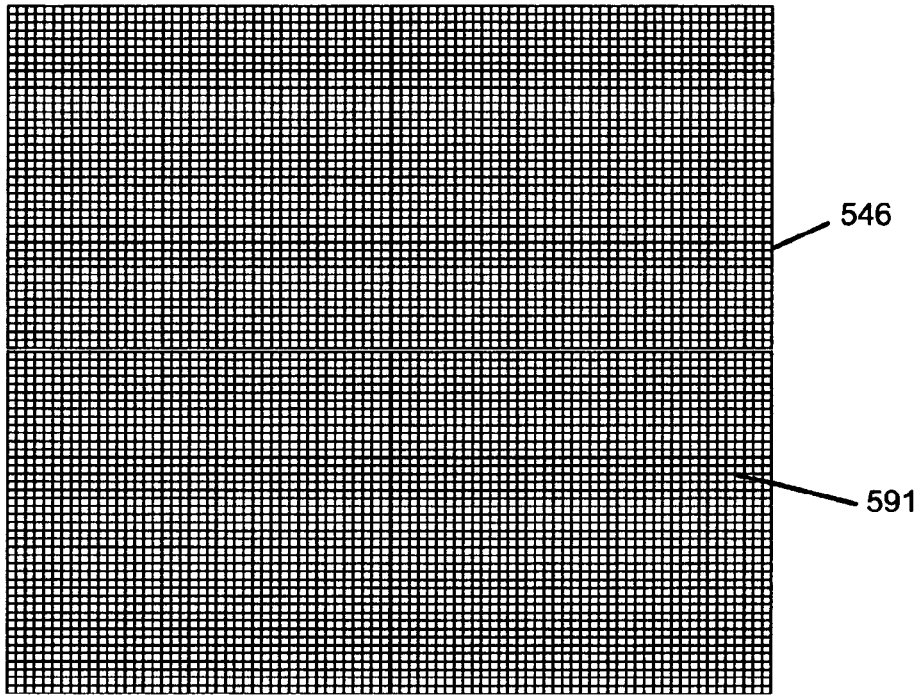
FIG. 5 shows a front view of the net with the small mesh that comprises the back net in the soccer training net.

In this embodiment, the soccer training net 332 is made by connecting together a front net 444, as shown in FIG. 4, with a back or rear net 546, as shown in FIG. 5. The length of the rear net 546 measured in the vertical direction exceeds the corresponding length of the front net 444 by between 75% and 150%. In this embodiment, the excess is 100%. Front net 444 is 2.4 m (8 ft) and rear net 546 is 4.8 m (16 ft).

Figure 6:
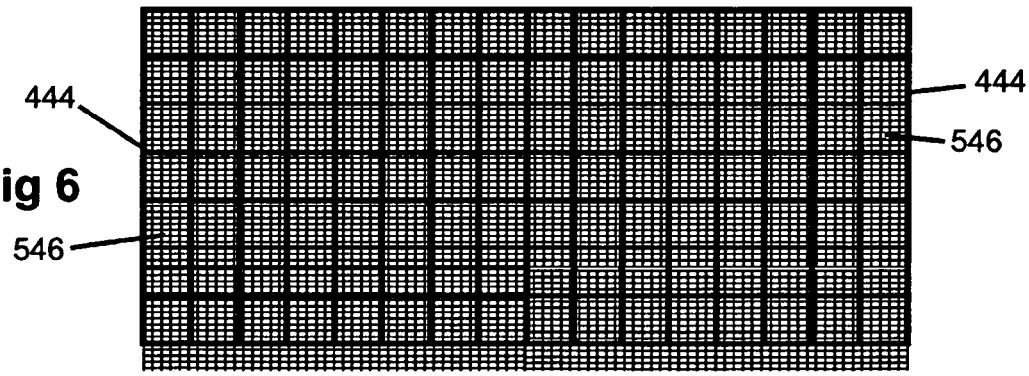
FIG. 6 shows a front view of the soccer training net with the large mesh net, illustrated as the large squares with darker & thicker shaded lines, placed on top of the smaller mesh net, illustrated as the small squares with dark and thinner shaded lines.

In this embodiment, the nets 444 and 546 are stitched together as shown in FIG. 6 using nylon or polyester or any other natural or synthetic fiber suitable for a thread. The netting is made of knitted nylon, cotton, hemp, polypropylene, rayon, polyester or any other natural or synthetic fiber suitable for netting. The use of natural or synthetic fiber netting allows the soccer training net 332 to be lightweight. In this embodiment, the thread and netting is made with polyester and contains appropriate chemicals that provide enhanced ultra violet protection.

The square mesh in net 444 has an aperture 490, with a width and height greater than the diameter of a soccer ball in the range of 20.32 cm (8 in) to 35.56 cm (14 in). In this embodiment, the square mesh has a width and height of approximately 30.48 cm (12 in). The square mesh in net 546 has an aperture 591, with a width and height less than the diameter of a soccer ball in the range of 1.27 cm (0.5 in) to 17.78 cm (7 in). In this embodiment, the square mesh has a width and height of approximately 2.54 cm (1 in). The diameter or thickness of the net line 493 is in the range of 0.08 mm (1/32 in) to 6.35 mm (1/4 in).

The net 444 and net 546 are colored differently so as to clearly define the pockets in the soccer training net 332.

Figure 7:
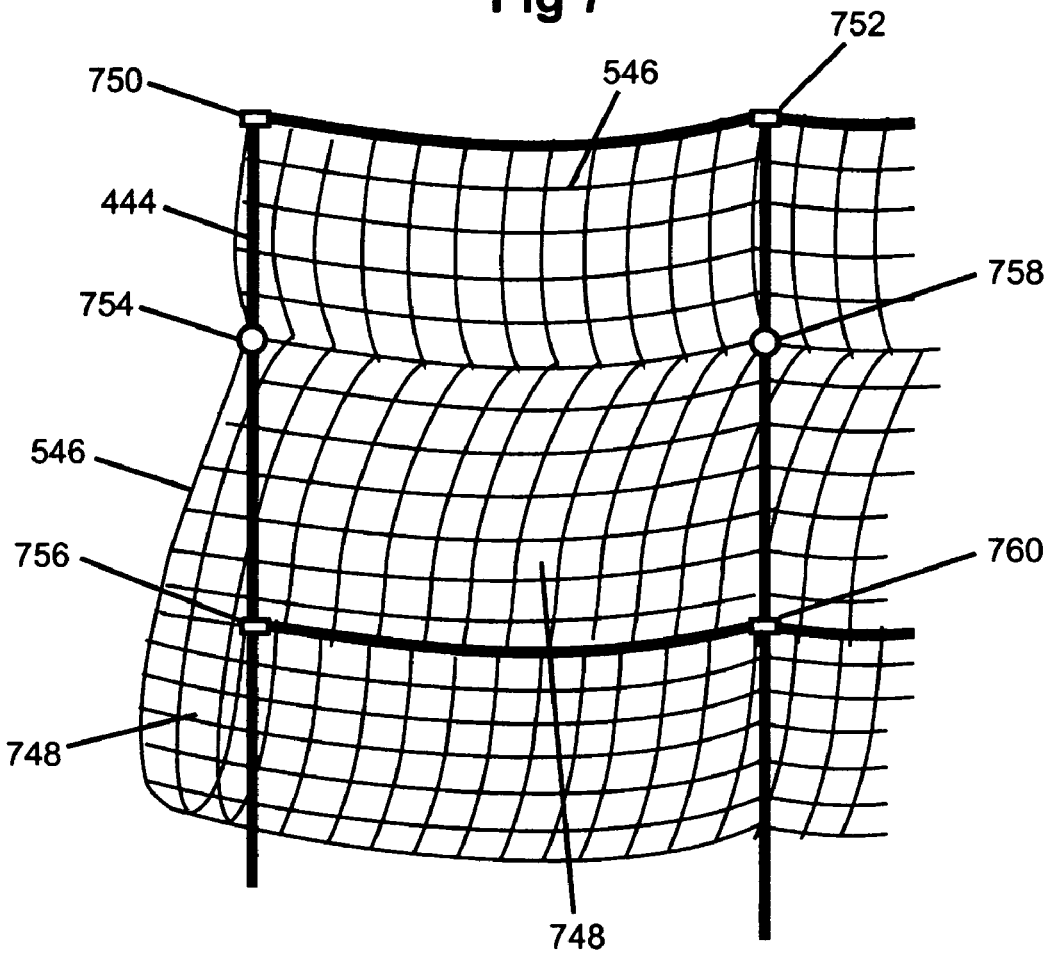
FIG. 7 shows a front view of a pocket of the soccer training net with dark thick lines representing the aperture of the large square mesh of the front net and the thin lines representing the apertures of the small square mesh of the rear net.
Figure 8:
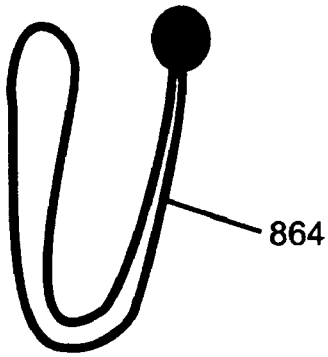
FIG. 8 shows a front view of the elastic "Bungee" cord with both ends inserted and secured in a plastic ball.
Figure 9:
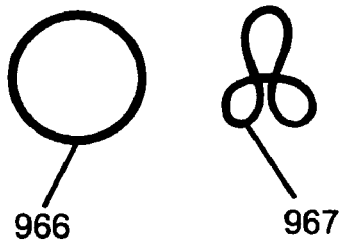
FIG. 9 shows a front view of an endless elastic loop or "Bungee" ring shown in two configurations.
Figure 10:
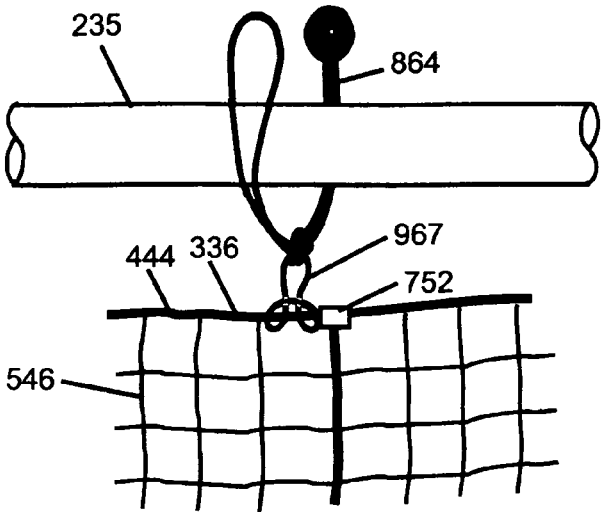
FIG. 10 shows a front view of small section of the soccer training net and the method of securing the soccer training net with the elastic "Bungee" cord with a plastic ball and an endless elastic loop or "Bungee" ring to the horizontal crossbar of a soccer goal.

In this embodiment, net 444 and net 546 are joined together to form a pocket 748 as illustrated in FIG. 7.

A corner 750 of a large square mesh on net 444 is stitched or attached on top of a corner of a small square mesh on net 546. A corner 752, to the right of the corner 750, of the large square mesh on net 444 is stitched on top of the corner of the $12^{th}$ horizontal small square mesh on net 546. A corner of the $5^{th}$ square mesh down of net 546 from the corner 750 is stitched at 754 to the left vertical side of the large square mesh on the front net 444 A corner of the $24^{th}$ small square mesh down of net 546 from corner 750 is stitched to a corner 756 of the large square mesh on net 444. A corner of the $5^{th}$ square mesh down of net 546 from the corner 752 is stitched at 758 to the right vertical side of the large square mesh on the front net 444. A corner of the 24$^{th}$ small square mesh down of the net 546 is stitched to a corner 760 of the large square mesh on net 444.

This process is repeated for the full width and length of the soccer training net 332. The outside perimeter of the assembled soccer training net 332 is serged with either nylon or polyester thread.

In this embodiment, the top edge 336 of the soccer training net 332 is attached to the crossbar 235 of the soccer frame 234 with a bungee cord 864 and a bungee ring 966 that is first attached in a configuration 967 to the top edge 336 adjacent to corner 752 as attached to the back net 546. In this embodiment, the bungee ring 966 is approximately 5.08 cm (2 in) in diameter and the bungee cord is approximately 0.48 cm (3/16 in) in diameter. The bungee cord 864 is secured with a knot to the bungee ring 966. In this embodiment, the bungee cord 864 is approximately 30.48 cm (12 in) in length. As shown in FIG. 3, the bungee ring 966 and bungee cord 864 combinations are attached at each point 752 along the top edge 336 and the corner points 750, or in this embodiment, every 30.48 cm (12 in). The bungee cord 864 is then secured to crossbar 235 of the soccer frame 234. As the width of the soccer training net 332 is greater that the length of the crossbar 235, the spacing between each bungee cord 864 attached to the crossbar 235 is less than the width of the square mesh net 444. In this embodiment, the spacing between each of the bungee cords 864 attached to the crossbar 235 is between 20.32 cm (8 in) and 22.86 cm (9 in). The bungee cord 864 is tightly secured to the crossbar 235 of the goal frame 234 in order that the distance between each bungee cord 864 attached to the crossbar 235 remains between 20.32 cm (8 in) and 22.86 cm (9 in).

Figure 11:
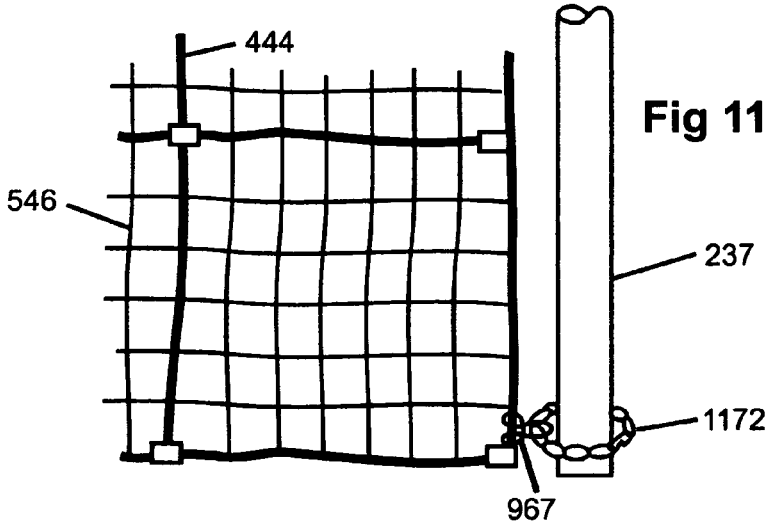
FIG. 11 shows a front view of the bottom right section of the soccer training net and the method of securing the soccer training net with an endless elastic loop or "Bungee" ring and a metal chain to the vertical post of a soccer goal.

The left side 340 and the right side 342 of the soccer training net 332 are secured at the bottom left and right side to the vertical goalposts 237 of the goal frame 234. FIG. 11 shows a bungee ring 966 in a configuration 967 that is secured to a mesh in the bottom pocket and then a post chain 1172, with a snap hook on one end, is passed through the loop on the bungee ring 966 in the configuration 967 and around the vertical goalpost 237. The post chain 1172 is of sufficient length to freely slide up and down the goal post 237 of the goal frame 234.

Figure 12:
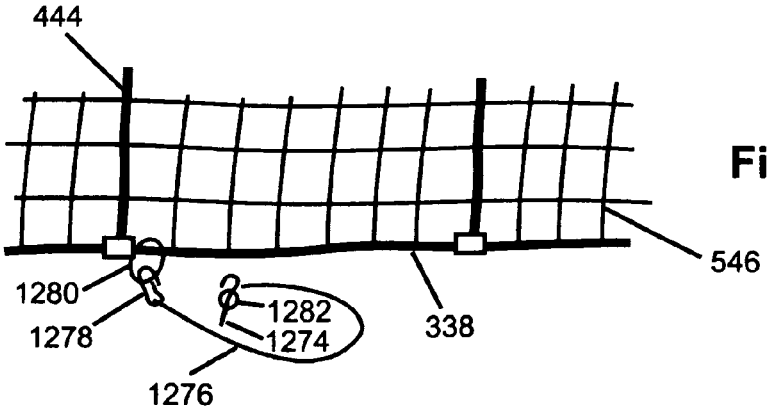
FIG. 12 shows a front view of the bottom section of the soccer training net that is secured to the ground with an elastic or "Bungee" cord attached to the soccer training net and to a spike driven into the ground.

The bottom edge 338 of the soccer training net 332 is secured to a ground spike 1274 as shown in FIG. 12 with a ground stretch bungee cord 1276 that has a snap hook 1278 on one end that attaches to a split ring 1280 secured to a mesh on the soccer training net 332. The other end of the ground stretch bungee cord 1276 is attached to a metal ring 1282. The ground spike 1274 slides through the metal ring 1282 and then the ground spike 1274 is driven into the ground to secure the ground stretch bungee cord 1276 and the soccer training net 332.

If the size of the goal frame 234 is up to 50% of the width of a full size goal, the bottom edge 338 of the soccer training net 332 requires either 0 or 1 ground stretch bungee cord 1276 attached to a ground spike 1274. During windy conditions, the soccer training net 332 requires one ground stretch bungee cord 1276 attached to a ground spike 1274. If the size of the goal frame 234 is between 50% and 100% of the width of a full size goal, the bottom edge 338 of the soccer training net 332 requires between 2 to 4 ground stretch bungee cords 1276 attached to ground spikes 1274. In this embodiment as illustrated in FIG. 3, two ground stretch bungee cords 1276 are attached to two ground spikes 1274.

Figure 13:
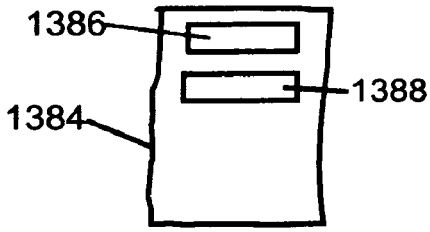
FIG. 13 shows a front view of the back of a target flag with two mutually adhesive or "Velcro" tapes.
Figure 14:
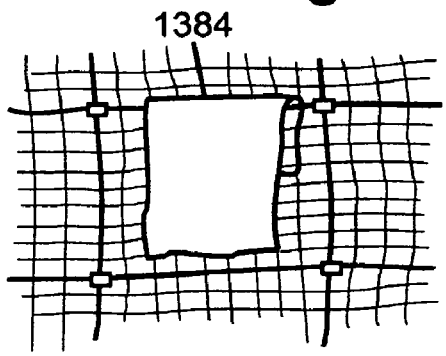
FIG. 14 shows a front view of the target flag attached to one of the pockets of the soccer training net.

A target flag 1384 as shown in FIG. 13 made with flexible natural or synthetic material such as nylon, polyester or cotton can be attached to any pocket on the soccer training net 332. The target flag 1384 has a width and length that is smaller than the dimensions of the square mesh of the front net 444. On one side of the target flag 1384 are attached two Velcro strips, one strip with hooks 1386 and the other with loops 1388. The target flag 1384 is secured to the front net 444 as shown in FIG. 14.

The target flags 1384 can have different colors to highlight different target areas on the soccer training net 332.

The soccer training net 332 is portable. It is easily rolled up into a compact shape and may be easily transported and stored in a draw-string bag or other small container.

Operation of First Embodiment

The manner of using the soccer ball catching system 230 is similar to that for nets in present use. In use, a practicing player will project a ball towards the soccer training net 332 as shown in FIG. 1. The ball will first pass through one of the apertures 490 of the front net 444 and then strike the back wall of the horizontal pocket 748 provided by the rear net 546 where it will give up its kinetic energy and fall into the lower portion of such pocket. However, in order to create this pocket, a certain amount of the soccer training net 332, a cone, parabolic like shape, has to wrap around the ball, travel in the direction of the ball, decelerate the ball and in the process remove the kinetic energy of the ball. Only after the ball has lost most of its kinetic energy, will the ball be able to slide down the rear small aperture net 546 and become trapped by this extra small mesh and the bottom of the net 444. If the net does not wrap around the ball and absorb the kinetic energy of the ball, the small net 546 will act as an immovable object and the ball will rebound from the small net 546 without sliding down into the drooping pocket.

In this embodiment, the top edge 336 and bottom edge 338 as shown in FIG. 3 have a length between 1.33 and 1.375 times the cross bar width 235 of the soccer frame 234. The excess width of the soccer training net 332 relative to the crossbar 235 width of the soccer frame 234 provides the excess loose net that allows a pocket in the soccer training net 332 to wrap itself around the ball on impact and create a cone that moves in the direction of the ball.

The kinetic energy of the ball is then absorbed by the soccer training net 332, the elastic bungee rings 966, the bungee cords 864 and the ground stretch bungee cords 1276. The metal post chains 1172 allow the soccer training net 332 to freely travel up and down the vertical posts 237 of the soccer frame 234, thereby enabling the soccer training net 332 to further absorb the ball's kinetic energy. Unlike the prior art in GB2057895, this embodiment provides several means of decreasing the kinetic energy of ball.

In this embodiment of the soccer ball catching system 230, when the ball hits the front of the soccer training net 332 and first passes through the large aperture 490 of the front net 444, the ball capture percentage at the point of impact is as high as 90%.

In this embodiment of the soccer ball catching system 230, when the ball hits the back of the soccer training net 332 and hits the small apertures 591 of the rear net 546, the ball capture percentage at the point of impact is as high as 80%. When the ball hits the small apertures 591 of the rear net 546, this rear net 546 is pushed through the large mesh aperture 490 of the front net 444 and then the ball falls into this inverted pocket.

In this embodiment, the length of the rear net 546 measured in the vertical direction exceeds the corresponding length of the front net 444 by 100%. The amount of the excess in the vertical length of rear net 546 determines the depth of the pocket 748 in FIG. 7. If the excess of the rear net 546 exceeds by 150% the length of the front net 444, then a soccer ball contained in a pocket will be positioned directly behind the top part of the pocket that is located immediately below the pocket containing the ball. It has been observed that when a soccer ball hits the pocket located below the pocket already containing the soccer ball, this soccer ball will frequently rebound or ricochet off the soccer ball contained in the above pocket. In this embodiment, the pocket depth helps minimize rebound and contributes to the high ball capture percentages.

This ball capture percentage provides the required training feedback to players and coaches making the soccer ball catching system 230 suitable for training purposes and hence, commercially attractive.

It is a primary object of this embodiment to provide a soccer ball catching system 230 that may rapidly increase a player's foot and heading skills by providing information as to where the ball crossed over the goal line which could be anywhere in the rectangular opening created by the soccer goal frame 234. A further object of this embodiment is to provide a soccer ball catching system 230 that provides reliable ball capture information when the ball hits the front of the soccer training net 332, front being defined as the ball first going through the large aperture 490 of the net 444 and then hitting the small apertures 591 of the net 546. Another object of this embodiment is to provide a soccer training system 230 that can be used from both sides of the soccer training net 332 thereby increasing player participation and providing a superior cardiovascular workout for the players. Still another object of this embodiment is to provide a soccer ball catching system 230 that provides reliable ball capture information when the ball hits the back of the soccer training net 332, back being defined as the ball first hitting the small apertures 591 of the net 546, pushing this net 546 through the large mesh aperture 490 of the net 444 and then falling into this inverted pocket. Still another object of this embodiment is to provide a soccer ball catching system 230 with movable target flags 1384 whose use would allow the practice of entertaining exercises as well as competitive games that are enjoyable and are designed to enhance soccer skills.

Soccer players, using the soccer ball catching system 230, can remove balls caught by the soccer training net 332 by placing their hand under the ball and the pocket and flicking their wrist upward.

Figure 15:
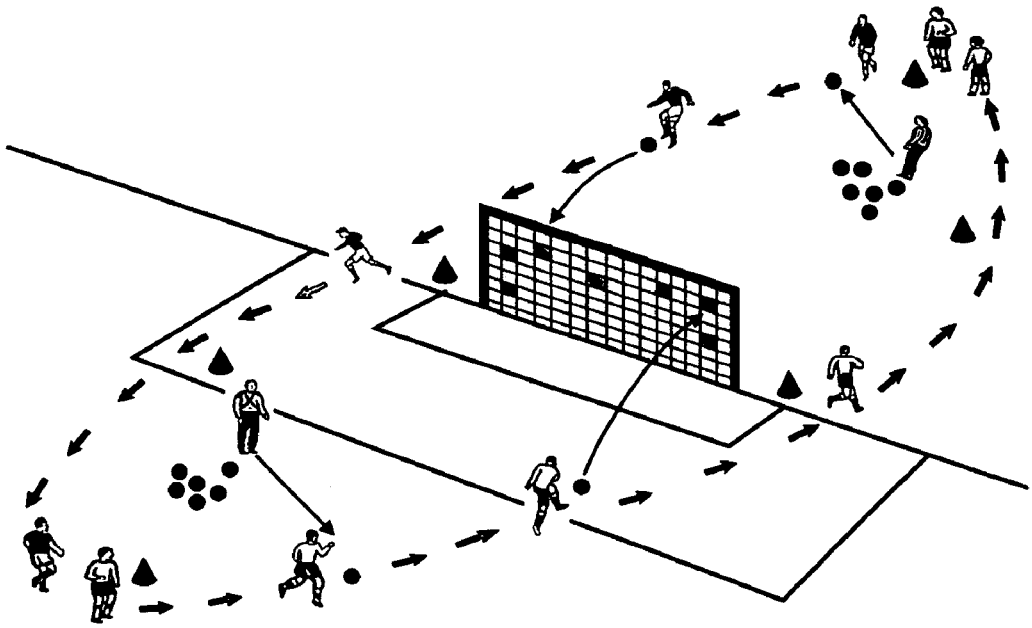
FIG. 15 shows a perspective view of the soccer ball catching system used with a circuit drill, which combines receiving a pass whilst running, running with the ball, shooting at a target then finishing with a fitness sprint to the other side of the net.

This embodiment of the soccer ball catching system 230 enables players and coaches to use drills that involve a greater number of participants than prior art embodiments. A circuit drill illustrated in FIG. 15 is designed to allow the use of both sides of the soccer training net 332 simultaneously. This high-energy circuit drill, which provides a superior workout, combines receiving a pass while running, running with the ball, shooting at a target, then finishing with a fitness sprint and repeating the process on the other side of the soccer training net 332. As there are two circuit drills occurring simultaneously, the waiting time to participate is reduced by up to 50%, thereby increasing player involvement and concentration.

Most practice drills that can only be performed using only one side of prior art embodiments can now be performed on both sides of this embodiment of the ball catching soccer system 230. Several examples are illustrated in FIG. 16, FIG. 17, FIG. 18, FIG. 19 and FIG. 20.

Figure 16:
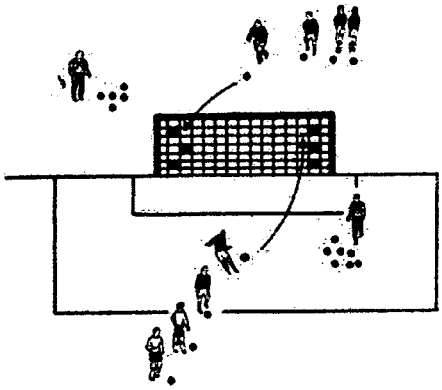
FIG. 16 shows a front view of the soccer ball catching system used with a penalty practice drill, which allows the player to develop several target areas for placing the penalty shot.

In the game of soccer a goal is awarded when the whole of the ball has crossed the goal line. When practicing penalty shots as shown in FIG. 16 and direct free kicks as shown in FIG. 7 it is important to know exactly where the ball crosses the goal line. In practice sessions this is more important than seeing where the ball hits the back of a regular goal net. When a penalty kick is awarded during a soccer game it becomes a one on one situation between a single player (shooter) and the goalkeeper of the opposing team. The ball is placed on the penalty spot located 10.97 m (12 yards) out from the centre of the goal. When given the signal by the referee, the shooter attempts to kick the ball past the goalkeeper and into the goal net. In this embodiment of the soccer ball catching system 230 the ball will land in a pocket 748 and will be held directly above the goal line indicating exactly where the ball crossed the goal line. The feed back from this situation shows the captured ball's vertical distance from the crossbar 235 and the captured ball's horizontal distance from the vertical goal post 237. If the ball is held in a pocket 748 close to one of the vertical goal posts 237 it would also indicate the probability of the ball being out of the goalkeepers reach. To improve the shooting skills and accuracy of the penalty taker a number of target flags 1384 can be hung on the net. Once a player can consistently hit their chosen target flags 1384 that player will have developed accuracy and confidence when called upon to take a penalty shot during a soccer game. This embodiment of the soccer ball catching system 230 will enable players to quickly and effectively develop their own personal variety of penalty shots.

Figure 17:
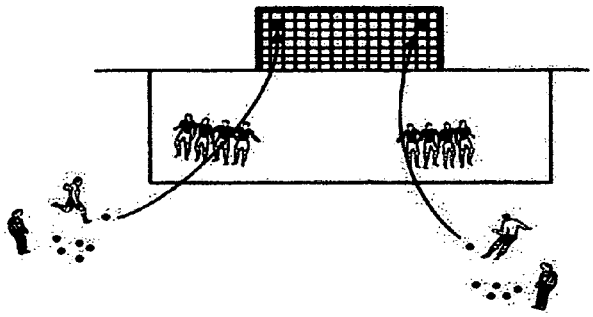
FIG. 17 shows a front view of the soccer ball catching system used with a direct free kicks drill, which can be practiced from any angle and distance and is the drill for developing the art of bending the ball.

These principles can also be applied to the free kicks/bending the ball drill as shown in FIG. 17, a direct free kicks/bending the ball drill that enables players to practice direct free kicks from any angle and distance. This is an excellent drill for developing the art of bending the ball.

Figure 18:
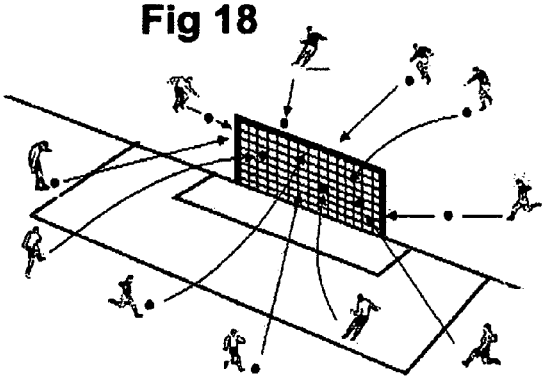
FIG. 18 shows a perspective view of the soccer ball catching system used with a shooting at random drill, which allows players to have fun by shooting at random from any distance and any angle from both sides of the net.

In FIG. 18, a shooting at random drill is a good drill to start a soccer training session.

Figure 19:
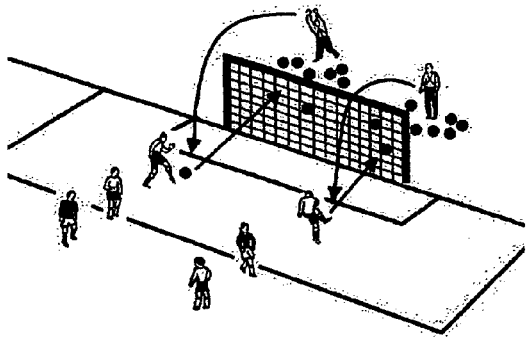
FIG. 19 shows a perspective view of the soccer ball catching system used with the shooting on the volley and half volley drill, which allows players to practice the technique of hitting the ball while it is in the air (volley) or when it hits the ground (half volley).

In FIG. 19, a shooting on the volley/half volley drill provides players with the opportunity to master the art of shooting on the volley. This drill is designed to practice the technique of hitting the ball while it is in the air (volley) or when it hits the ground (half volley). The drill enables advanced players to fine-tune their shooting accuracy.

Figure 20:
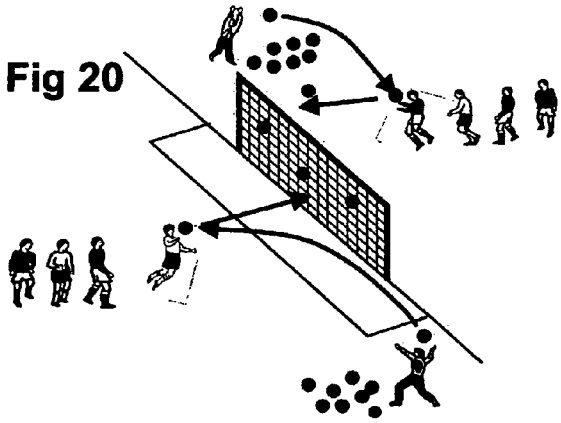
FIG. 20 shows a perspective view of the soccer ball catching system used with the heading practice drill, which allows players to learn how to connect and subsequently direct the trajectory of the ball.

In FIG. 20, a heading drill provides players the opportunity to practice an important and valuable skill.

Additional Embodiments

Figure 21:
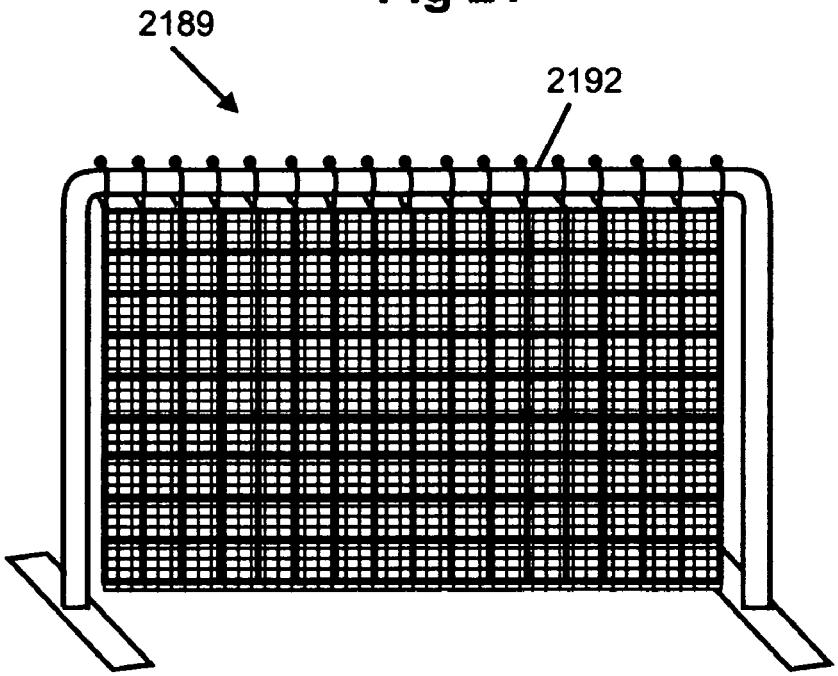
FIG. 21 shows a front view of the portable soccer ball catching system, which includes the soccer training net and a portable rectangular frame.
Figure 22:
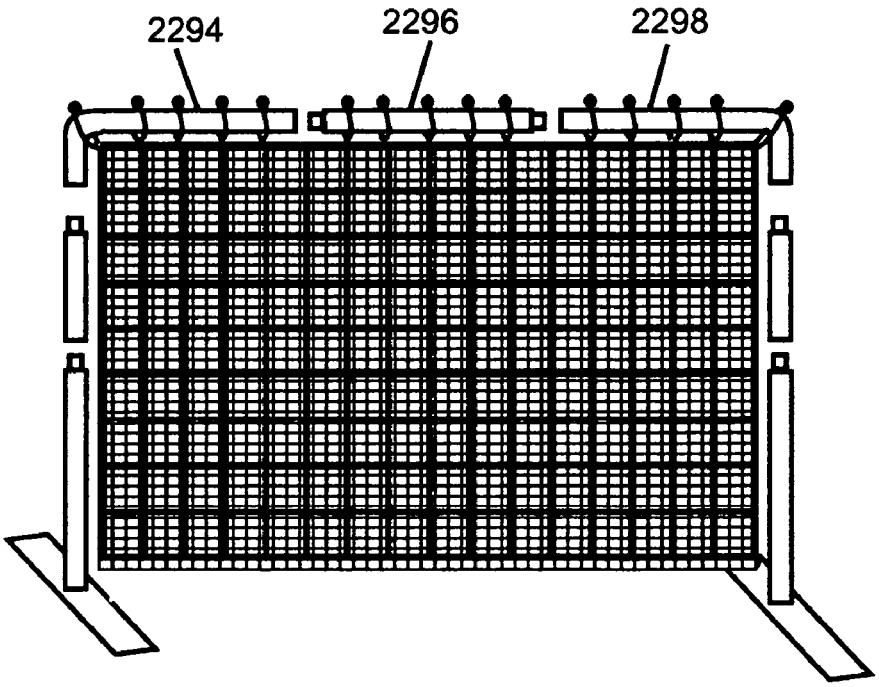
FIG. 22 shows a front view of the disassembly of the portable goal frame.

Another embodiment of the ball catching system for soccer training is a portable ball catching soccer system 2189. The portable ball catching soccer system 2189 has a rectangular soccer training net 332, described in the first embodiment, and attached to a portable rectangular frame 2192 as shown in FIG. 21, a frame design that is typical of commercially available portable goals. The frame 2192 can be easily disassembled as shown in FIG. 22 and all components can be easily transported in an appropriate bag. After the crossbar pipes 2294, 2296 and 2298 are disassembled, the soccer training net 332 is not removed from these crossbar pipes. The crossbar pipes 2294, 2296 and 2298 are folded on each other and the soccer training net 332 is rolled up. This rolled up configuration of the soccer training net 332 is then secured further to the folded crossbar pipes 2294, 2296 and 2298 with bungee cords similar to the bungee cords 864.

The ball catching soccer system 2189 is portable as the disassembled frame and all components can be easily transported in an appropriate bag.

Advantages:

From the descriptions above, a number of advantages of some embodiments of soccer ball catching system become evident:

The ball capture percentage at the point of impact for the front of the ball catching soccer system is approximately 80% higher than the ball capture percentage of the prior art embodiment utilizing a similar pocket design.

The ball capture percentage at the point of impact for the back of the ball catching soccer system is approximately 100% higher than the ball capture percentage of the prior art embodiment utilizing a similar pocket design.

The embodiments of the soccer ball catching system feature approximately 264 target pockets for a full size soccer goal frame, the largest number of pockets as compared to any prior art embodiments. These 264 pockets are available to a player using either the front or the back of the ball catching soccer system.

With the large number of pockets, a player can practice shooting the ball at any part of the goal opening.

As the soccer ball catching system can be used from both sides, drills can be fast paced, thereby maintaining the interest of soccer players, while providing a superior cardiovascular workout to both young and older players.

Target flags can be attached to any of the pockets, thereby providing players a challenging and fun way to improve their shooting and heading skills.

The portable soccer ball catching system can be set up on the field by two individuals in about 5 minutes.

Soccer players can easily remove balls caught by the soccer training net by placing their hand under the ball and the pocket and flicking their wrist upward.

CONCLUSION, RAMIFICATIONS, AND SCOPE OF INVENTION

The two embodiments of the soccer ball catching system 230 and the portable soccer ball catching system 2189 provide a more versatile, effective and productive soccer training system that can be used by coaches or individual players on soccer pitches, parks or in backyards.

In these two embodiments, the ball capture percentage at the point of impact is as high as 90% when the ball hits the front of the soccer training net 332. When the ball hits the back of the soccer training net 332, the ball capture percentage at the point of impact is as high as 80%. These high ball capture percentages are the result of various features incorporated into the ball catching soccer system embodiments 230 and 2189 to effectively decrease the kinetic energy of the soccer ball in order that the pockets described in prior art can retain the ball instead of acting as an immovable object and rebounding the ball.

While the above descriptions contain many specificities, these should not be construed as limitations on the scope of the invention, but rather as an exemplification of several preferred embodiments thereof. Many other variations are possible. For example, the portable soccer ball catching system 2189 can be utilized for golf, football, baseball, tennis, polo and volleyball by modifying the dimensions of the pockets in the soccer training net 332 to accommodate the dimensions of balls used in these sports. For tennis and indoor activities, the base of the rigid portable rectangular frame 2192 would be secured to the tennis court or gym floor with appropriate weighted containers rather than with the use of ground spikes.

I claim:

1. A method for training soccer players comprising:

1) providing a soccer ball;

2) providing a ball catching system comprising:

(a) a frame comprising a rigid horizontal member and two rigid vertical members;

(b) a soccer training net comprising a flexible body component having a top edge, a bottom edge and two side edges, said body component having a plurality of pockets covering all the surface of said soccer training net, said pockets having a substantially square aperture, said pockets consisting of two rectangular nets, a front net with a predetermined aperture larger than the diameter of said soccer ball and a rear net with a predetermined aperture smaller than the diameter of said soccer ball whereby said soccer training net can capture and hold in place at point of impact approximately 90% of said soccer balls passing through said apertures of said front net, whereby said soccer training net can capture and hold in place at point of impact approximately 80% of said soccer balls hitting back of said soccer training net, wherein the two side edges of said rear net are approximately 1.75 to 2.50 times the length of the two side edges of said front net;

(c) said soccer training net being attached on said frame:

(d) said soccer training net being secured to the ground, 3) providing several flags, said flags being capable of being attached to any of said pockets on said soccer training net whereby soccer players can improve shooting skills and accuracy and develop a variety of penalty shots and the art of bending said soccer ball.

2. The method of claim 1 including the step of providing the said front net and said rear net in different colors.

3. The method of claim 1 including the step of having the said front net and said rear net made of material selected from the group consisting of synthetic and natural fibers such as knitted nylon, cotton, hemp, polypropylene, polyethylene, rayon and polyester.

4. The method of claim 1 whereby said front net and said rear net are joined together with threads from the group consisting of synthetic and natural fibers such as knitted nylon, cotton, hemp, polypropylene, polyethylene, rayon and polyester.

5. The method of claim 1 including the step of developing and using practice drills using both sides of said soccer training net whereby several drills can be conducted simultaneously, saving valuable coaching time, increasing player participation and providing a superior cardiovascular workout for players.

6. The method of claim 1 whereby the said flags can be of different colors.

7. A method for training soccer players comprising:

1) providing a soccer ball;

2) providing a ball catching system comprising:

(a) a frame comprising a rigid horizontal member and two rigid vertical members;

(b) a soccer training net comprising a flexible body component having a top edge, a bottom edge and two side edges, said body component having a plurality of pockets covering all the surface of said soccer training net, said pockets having a substantially square aperture, said pockets consisting of two rectangular nets, a front net with a predetermined aperture larger than the diameter of said soccer ball and a rear net with a predetermined aperture smaller than the diameter of said soccer ball whereby said soccer training net can capture and hold in place at point of impact approximately 90% of said soccer balls passing through said apertures of said front net, whereby said soccer training net can capture and hold in place at point of impact approximately 80% of said soccer balls hitting back of said soccer training net, wherein the vertical length of said rear net in each pocket are approximately 1.75 to 2.50 times the vertical length of said front net;

(c) said soccer training net being attached on said frame;

(d) said soccer training net being secured to the ground, 3) providing several flags, said flags being capable of being attached to any of said pockets on said soccer training net whereby soccer players can improve shooting skills and accuracy and develop a variety of penalty shots and the art of bending said soccer ball.

8. The method of claim 7 including the step of providing the said front net and said rear net in different colors.

9. The method of claim 7 including the step of having the said front net and said rear net made of material selected from the group consisting of synthetic and natural fibers such as knitted nylon, cotton, hemp, polypropylene, polyethylene; rayon and polyester.

10. The method of claim 7 whereby said front net and said rear net are joined together with threads from the group consisting of synthetic and natural fibers such as knitted nylon, cotton, hemp, polypropylene, polyethylene, rayon and polyester.

11. The method of claim 7 including the step of developing and using practice drills using both sides of said soccer training net whereby several drills can be conducted simultaneously, saving valuable coaching time, increasing player participation and providing a superior cardiovascular workout for players.

12. The method of claim 7 whereby the said flags can be of different colors.

* * * * *